US005409163A

United States Patent [19]

Erickson et al.

[11] Patent Number: 5,409,163

[45] Date of Patent: Apr. 25, 1995

[54] ULTRASONIC SPRAY COATING SYSTEM WITH ENHANCED SPRAY CONTROL

[75] Inventors: Drew D. Erickson, Newburyport; Stuart J. Erickson, Marblehead, both of Mass.

[73] Assignee: Ultrasonic Systems, Inc., Amesbury, Mass.

[21] Appl. No.: 156,314

[22] Filed: Nov. 22, 1993

Related U.S. Application Data

[63] Continuation-in-part of Ser. No. 116,015, Sep. 2, 1993, which is a continuation-in-part of Ser. No. 791,412, Nov. 13, 1991, abandoned, which is a continuation-in-part of Ser. No. 469,937, Jan. 25, 1990, abandoned.

[51] Int. Cl.[6] ..... B05B 17/06

[52] U.S. Cl. ..... 239/4; 239/102.2; 239/292; 239/300; 239/420

[58] Field of Search ..... 239/4.8, 102.1, 102.2, 239/290, 292, 300, 420

[56] References Cited

U.S. PATENT DOCUMENTS

| | | | |
|---|---|---|---|
| 3,198,170 | 8/1965 | Onishi | 118/627 |
| 3,275,059 | 9/1966 | McCullough | 239/102.2 X |
| 3,790,079 | 2/1974 | Berglund et al. | 239/102.2 X |
| 3,970,250 | 7/1976 | Drews | 239/102.2 |
| 4,085,983 | 4/1978 | Durley, III | 239/102 |
| 4,319,716 | 3/1982 | Lauer | 239/102 |
| 4,474,326 | 10/1989 | Takahashi | 239/102.2 |
| 4,723,708 | 2/1988 | Berger et al. | 239/102.2 |
| 4,961,885 | 10/1990 | Aurahami et al. | 239/102.2 X |
| 5,219,120 | 6/1993 | Ehrenberg et al. | 239/11 |

FOREIGN PATENT DOCUMENTS

| | | | |
|---|---|---|---|
| 259267 | 10/1990 | Japan | 239/102.2 |

*Primary Examiner*—Andres Kashnikow
*Assistant Examiner*—Kevin P. Weldon
*Attorney, Agent, or Firm*—Heslin & Rothenberg

[57] ABSTRACT

An ultrasonic spray coating system includes a converter which converts high frequency electrical energy into high frequency mechanical energy thereby producing vibrations. The converter has a resonant frequency. A spray forming head is coupled to the converter and is resonant at the resonant frequency of the converter. The spray forming head has a spray forming tip and concentrates the vibrations of the converter at the spray forming tip. A source of high frequency alternating voltage is electrically connected to the converter and produces a controlled level of electrical energy at an operating frequency of the spray forming head and converter whereby the atomizing surface is vibrated ultrasonically. A liquid supply applicator is in close proximity with the spray forming tip and spaced therefrom. The liquid supply applicator has an output surface having an orifice therein and the output surface is in close proximity with the spray forming tip and spaced therefrom. The output surface of the liquid supply applicator and the spray forming tip are at right angles to each other, whereby liquid supplied by the applicator is applied to the spray forming tip where the liquid is atomized by the ultrasonic vibrations of the spray forming tip and thereby changed to a spray. An air entrainment mechanism is associated with the spray for affecting and controlling the spray.

19 Claims, 7 Drawing Sheets

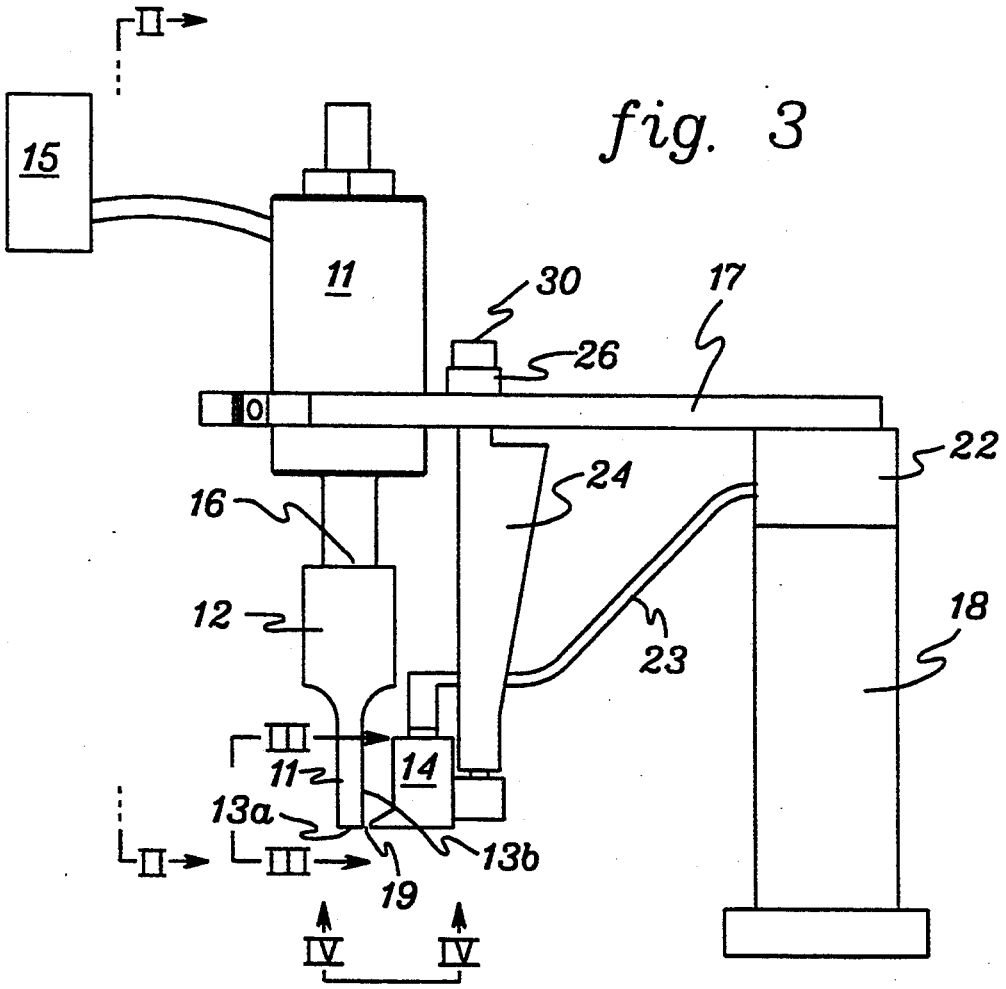
fig. 3
fig. 4
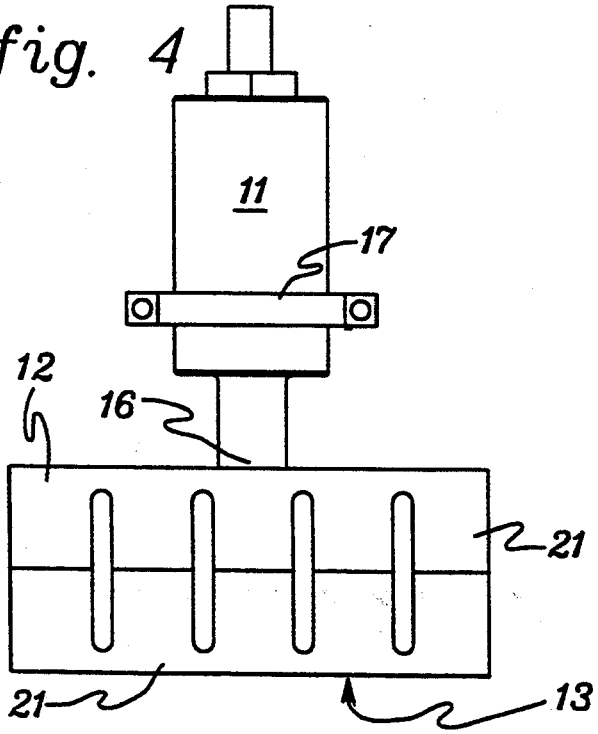
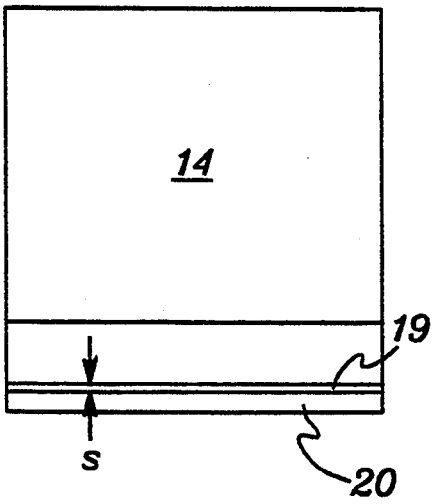
fig. 5

ULTRASONIC SPRAY COATING SYSTEM WITH ENHANCED SPRAY CONTROL

CROSS-REFERENCE TO RELATED APPLICATIONS

This application is a continuation-in-part of application Ser. No. 08/116,015, entitled: "Ultrasonic Spray Coating System," filed Sep. 2, 1993, which is expressly incorporated herein by reference, and which is itself a continuation-in-part of application Ser. No. 07/791,412, entitled: "Ultrasonic Spray Coating System," filed Nov. 13, 1991, now abandoned which itself is a continuation-in-part of application Ser. No. 07/469,937, entitled: "Ultrasonic Spray Coating System," filed Jan. 25, 1990, now abandoned.

TECHNICAL FIELD

The present invention relates to an ultrasonic spray coating system.. More particularly, the invention relates to an ultrasonic spray coating system having a liquid applicator in close proximity to a spray forming head. This invention relates to an atomizing spray coating system appropriate for applying a wide variety of coating materials to products in industry. More particularly, the invention relates to a spray coating system which includes liquid supply means, air entrainment means and high energy ultrasonic structures in conjunction with high energy ultrasonic power generators to produce the desired results.

Further, the invention relates to an ultrasonic spray coating system with a liquid supply control system in close proximity with, but not contacting, the spray forming head, and to the design, and to control of the vibrating surface and the atomized spray through an air entrainment system.

BACKGROUND ART

Presently available techniques for atomizing and applying coating materials to surfaces of products include discharging liquids through small apertures under high applied pressure, introducing the liquid to the center of a high speed rotating disk, introducing the liquid into a high velocity stream of air, introducing a liquid jet or film to an intense electrical field and introducing the liquid to a surface which is caused to vibrate at an ultrasonic frequency. The advantages and disadvantages of the various known implementations of these atomizing techniques are extensively documented in technical journals and texts. For example, a comprehensive technical survey of the known methods is set forth in "Atomization and Sprays," by Arthur J. Lefebvre, Purdue University, Hemisphere Publishing Corporation, 1989.

Ultrasonic liquid atomizing spray systems have generated considerable attention as evidenced by prior U.S. patents. It is known in the prior art that a film of liquid on a surface can be converted into a mist of small drops by vibrating the surface at an ultrasonic rate. Also, prior art teaches that the size of the drops in the mist are related to the rate of vibration. However, problems associated with introducing liquid to a vibrating surface in a manner to produce dependable, uniform spray patterns have significantly limited the effectiveness and therefore the commercial acceptance of prior art approaches. Also, problems with controlling the precise amplitude of the vibrations in the various sections of the surface significantly influence the characteristics of the produced spray and affect the quality of an applied coating.

In known ultrasonic spray coating systems, the coating material is first disintegrated into a fog of tiny droplets which is injected into a laminar gas stream to create a laminar material spray. The spray is directed at an item to be coated. The flow rate of material being disintegrated is regulated to control the volume of material injected into the gas stream thereby controlling the volume of material applied to the item and, hence, the concentration of solids which remain after coating.

The known method of coating is very expensive and difficult to undertake. Furthermore, it is inefficient, because it coats everything in the area of the item, as well as the item. The prior art approaches have failed to provide adequate means to achieve spray patterns which produce coatings of desired uniformity and definition. There is a great commercial need for improved techniques and systems for applying liquid coating material to surfaces such as printed circuit boards, semiconductor wafers, continuous sheets of float glass, automobile trim, continuous sheets of woven and non-woven materials, etc., with improved precision, efficiency and rapidity.

Ultrasonic liquid atomizing spray systems have generated considerable attention. It is shown in the prior art that a film of liquid on a surface can be converted into small drops by vibrating the surface at an ultrasonic rate. Prior art teaches that the size of the drops are a function of the vibration frequency and amplitude. Also, prior art shows many ways of introducing the liquid to a vibrating surface. However, problems associated with introducing a sufficient flow of liquid to an ultrasonically vibrating surface in a manner to produce dependable, uniform spray patterns have significantly limited the effectiveness and therefore the commercial acceptance of prior art approaches. Additionally, problems with controlling the flow of ultrasonic energy into the atomizing liquid significantly influence the characteristics of the produced spray and the resultant quality of an applied coating.

Prior art approaches generally describe various cylindrical, nozzle-shaped ultrasonic structures, with the liquid spray material being introduced in the center of the nozzle spray forming tip and also occupying a portion of the path of ultrasonic energy propagation. The basic difficulties with these approaches are that considerable ultrasonic energy is lost to the liquid supply connections and to the liquid within the structure, and the spray patterns produced by such structures are cylindrical thereby coating thickness distributions on surfaces tend towards a gaussian rather than a uniform shape.

Thus, most, if not all, prior atomizers produce questionable or unsatisfactory shape and uniformity characteristics for precision coating applications. Significant commercial potential therefore exists for a system which forms an ultrasonically atomized mist of fine droplets from a coating of liquid in a spray having a predetermined (but controllable) pattern, uniformity and velocity such that deposition of a precision shape and uniformity may be made on an object surface to be coated with a minimum loss of the coating liquid to the environment or to unwanted surfaces. The present invention provides such a system.

DISCLOSURE OF THE INVENTION

Briefly summarized, the present invention comprises an ultrasonic spray coating system having a converter mechanism for converting high frequency electrical energy into high frequency mechanical energy to thereby produce vibrations. The converter mechanism is designed to have one resonant frequency. A spray forming head is coupled to the converter mechanism and is resonant at the same resonant frequency. The spray forming head has a spray forming tip and concentrates the vibrations of the converter at the spray forming tip. The spray forming tip has a feed blade and an atomizing surface. The spray forming tip concentrates a surface wave on the feed blade and a displacement wave on the atomizing surface from the vibrations of the converter. A high frequency alternating mechanism is electrically connected to the converter mechanism to produce a controllable level of electrical energy at the proper operating frequency of the spray forming head/-converter mechanism such that the spray forming tip is vibrated ultrasonically with a surface wave concentrated on the feed blade and a displacement wave concentrated on the atomizing surface.

A liquid supplier is provided having a liquid applicator in close proximity with the feed blade of the spray forming tip and spaced therefrom. The liquid applicator includes an output surface having an orifice therein. The output surface is in close proximity with the feed blade of the spray forming tip and spaced therefrom. The output surface of the liquid applicator and the feed blade of the spray forming tip are at substantially right angles to each other such that liquid supplied from the liquid applicator forms a bead or meniscus between the output orifice of the liquid applicator and the feed blade of the spray forming tip. The meniscus is formed and sustained by the flow of liquid from the output orifice of the liquid applicator and the ultrasonic surface wave that exists on the feed blade of the spray forming tip. The ultrasonic surface wave enables the liquid to 'wet-out' and adhere to the feed blade of the spray forming tip. The surface tension of the liquid allows the meniscus to form and constant flow of liquid sustains the meniscus. The longitudinal displacement wave (that displaces the atomizing surface) pumps the liquid from the feed blade to the atomizing surface. A film of liquid then forms on the atomizing surface and is transformed into small drops and propelled from the atomizing surface in the form of a rectilinear spray. Finally, a controllable gas entrainment mechanism is associated with the spray forming head for affecting and controlling the velocity and pattern of the resultant spray. Numerous system enhancements are also presented herein.

In all embodiments, the present invention comprises an ultrasonic spray coating system with spray velocity control which is inexpensive to manufacture and operate, and is simple to maintain and utilize. The system produces a coating of liquid of desired uniformity, precision, shape and thickness on a work surface. There is minimal waste of coating liquid with over 90% of the atomized liquid being delivered to the work surface to be coated. Special air directors expand the spray width (uniformly) to widths greater than that of the spray forming tip. Further, control of spray velocity is enhanced to facilitate coating application in various situations.

BRIEF DESCRIPTION OF THE DRAWINGS

These and other objects, advantages and features of the present invention will be more readily understood from the following detailed description of certain preferred embodiments of the present invention, when considered in conjunction with the accompanying drawings in which:

FIG. 3 is a block diagram of one embodiment of the ultrasonic spray coating system of the present invention;

FIG. 4 is a view, on an enlarged scale, taken along lines II—II of FIG. 3;

FIG. 5 is a view, on an enlarged scale, taken along lines III—III of FIG. 3;

BEST MODE FOR CARRYING OUT THE INVENTION

In general, the ultrasonic spray coating system comprises a converter for converting high frequency electrical energy from an electronic frequency controlled power generator into high frequency mechanical energy, to thereby produce ultrasonic energy and vibrations. The converter has a resonant frequency. A spray forming head is coupled to the converter and is resonant at the resonant frequency of the converter. The spray forming head concentrates the ultrasonic energy generated by the converter at a spray forming tip causing the tip to vibrate uniformly (with a surface wave on the feed blade and a displacement wave on the atomizing surface, both longitudinally) with an amplitude proportional to the electric energy applied to the converter. A liquid applicator is mounted in close proximity to the feed blade of the spray forming tip and spaced therefrom a small distance determined by the flow rate of liquid, surface tension, contact angle and other properties (in conjunction with the ultrasonic wave system established in the spray forming tip) which allow the liquid to form a meniscus in the gap between the applicator and the feed blade of the spray forming tip. (As used herein, a meniscus means a crescent-shaped body.)

Figure 1:
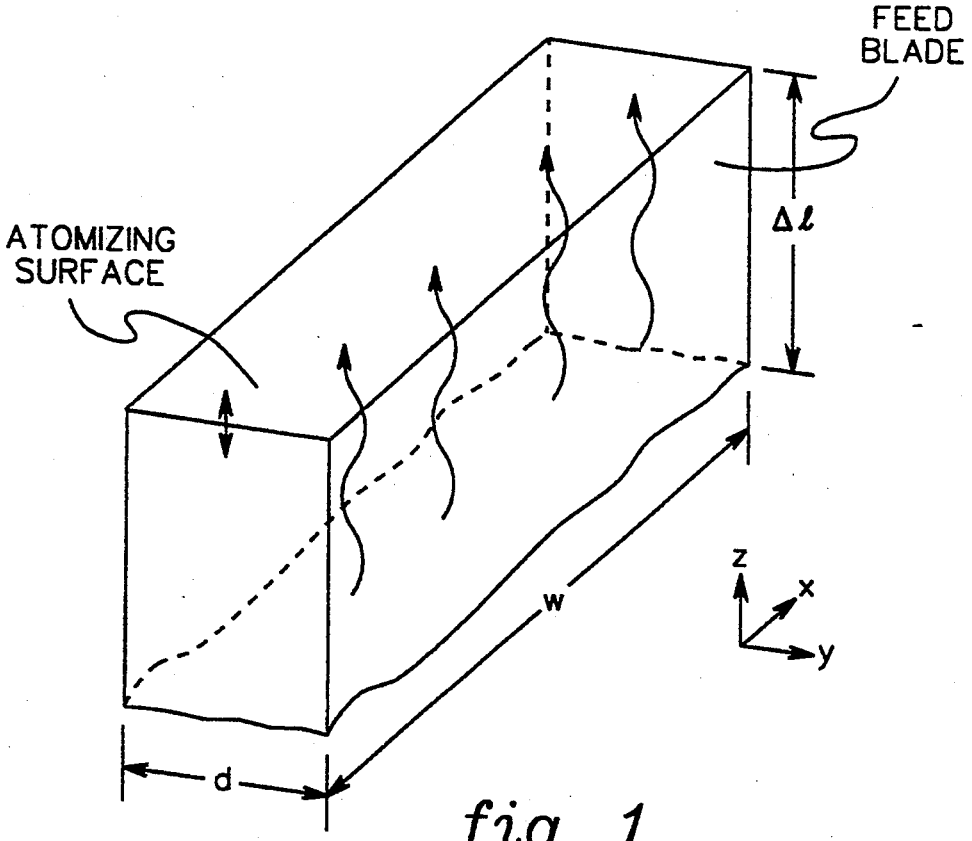
FIG. 1 is a partial perspective view of a spray forming tip pursuant to the present invention.

The spray forming tip, illustrated in FIG. 1, consists of surfaces (d w), (Δ1 w), and (d Δ1). The ultrasonic surface wave moves in the z direction longitudinally along surface (Δ1 w) and the ultrasonic displacement wave moves longitudinally (in the z-axis direction) and displaces surface (d w) in the z-axis direction. The surface (Δ1 w) is called the 'feed blade' and the surface (d w) is called the 'atomizing surface'. A meniscus of liquid forms between the feed blade and the 'slot-shaped' orifice of the liquid applicator in the presence of the ultrasonic surface and longitudinal displacement wave systems. The liquid applicator supplies liquid to the meniscus which adheres to the feed blade (Δ1 w) that, in turn, supplies the liquid to the atomizing surface (d w).

The liquid is transformed into a uniform spray as follows:

1) Liquid Applicator—the liquid applicator fulfills three functions that are necessary to create and sustain a uniform, lineal spray pattern.

First, the liquid applicator transforms the flow of liquid from a cylindrical shaped flow to a lineal flow equal to or less than the width (w) of the spray forming tip. The shape of the internal passageways of the liquid applicator transforms the flow of liquid from a cylindrical flow to a lineal-slot flow. The preferred embodiment of the liquid applicator is shown in FIG. 11*a* to FIG. 13*b*.

Features machined into the mating surfaces of a top plate 101 and a bottom plate 102 form the internal passageways of the liquid applicator. The top plate 101 has machined into its mating surface 103 an output surface 104 with radius '$R_1$' and a flat step 105 of depth s and width '$W_s$'. The bottom plate 102 has machined into its mating surface 106 an output surface 107 with radius '$R_1$' and a V-shaped flow distributor 108 with depth angle '$\alpha$' and width angle '$\beta$'. The top plate 101 and bottom plate 102 are joined with the top mating surface 103 facing the bottom mating surface 106. Two threaded fasteners are used to attach the bottom plate 102 to the top plate 101. The fasteners are secured through clearance holes located in the top plate to similarly located threaded holes in the bottom plate. The top plate 101 and bottom plate 102 joined together comprise a liquid applicator with an output orifice 114 and an output surface 115. The output orifice 114 is formed by the output step 105 on the top plate 101 and a portion of the mating surface 113 on the bottom plate 102.

A threaded liquid port 109 of diameter 'D' is machined through the top plate 101 and is centrally located on the top plate 101. A matching threaded liquid conduit fitting 110 threads into the liquid port 109. A flexible liquid conduit 111 is attached to the liquid conduit fitting 110. A suitable liquid supply system is attached to the other end of the liquid conduit, such as a pressurized reservoir, metering pump or gravity feed tank to supply liquid in a controlled manner to the liquid applicator.

Liquid enters the liquid port 109 in the top plate 101 of the liquid applicator. The liquid flows through the liquid port 109 and enters the apex 112 of the flow distributor 108 in the bottom plate 102. The liquid flow is redirected towards the output orifice 114 of the liquid applicator. The flow is contained in the flow distributor 108 by the mating surface 103 of the top plate 101. From the apex 112, the depth angle '$\alpha$' of the flow distributor 108 converges with the mating surface 103 of the top plate 101 towards the output orifice 114. Also from the apex 112, the width angle '$\beta$' of the flow distributor 108 diverges towards the output orifice 114. This geometry transforms the flow of liquid from cylindrical flow to a lineal slot flow.

Second, the design of the flow distributor 108 and the output orifice 114 of the liquid applicator ensures that the liquid flow is laminar for the liquid type and flow rate range. The cross-sectional area of the flow distributor 108 is maintained constant over the distance from the apex 112 of the flow distributor 108 to the output surface 115, so that the liquid is not appreciably accelerated as it flows through the liquid applicator. The depth 's' of the output step 105 is adjusted for different liquid types and flow rate ranges to ensure that the liquid is distributed uniformly across the output surface 113. The size of the output orifice 115 in conjunction with the flow distributor 108 ensures that the flow of liquid is laminar over the flow rate range and uniform across the output surface 113. The design of the output orifice 105 and flow distributor 101 is to ensure a steady, uniform flow of liquid from the output surface 113 of the liquid applicator to the feed blade of the spray forming head.

Figure 12:
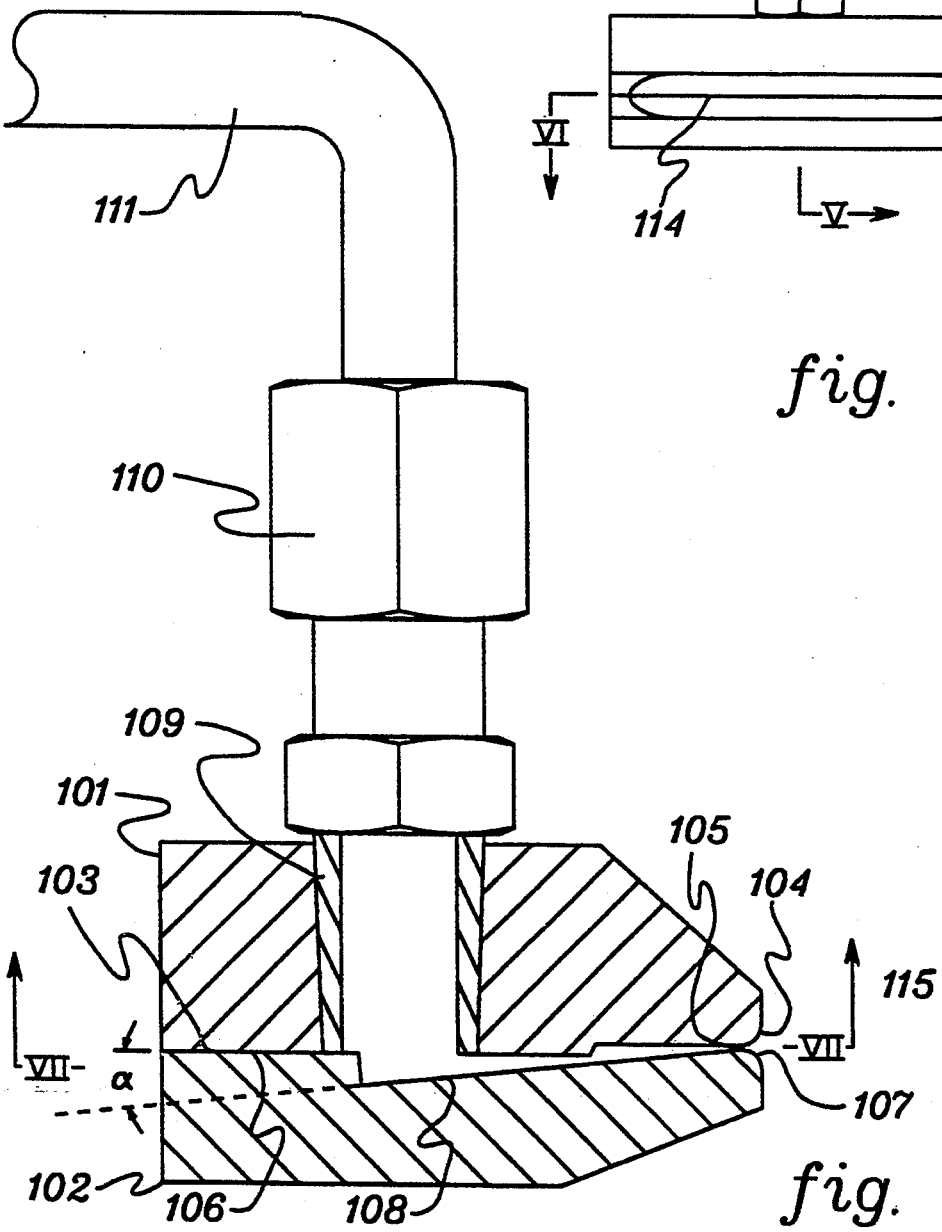
FIG. 12 is a cross-sectional view, on an enlarged scale, taken along lines V—V of FIG. 11*a;*
Figure 13A:
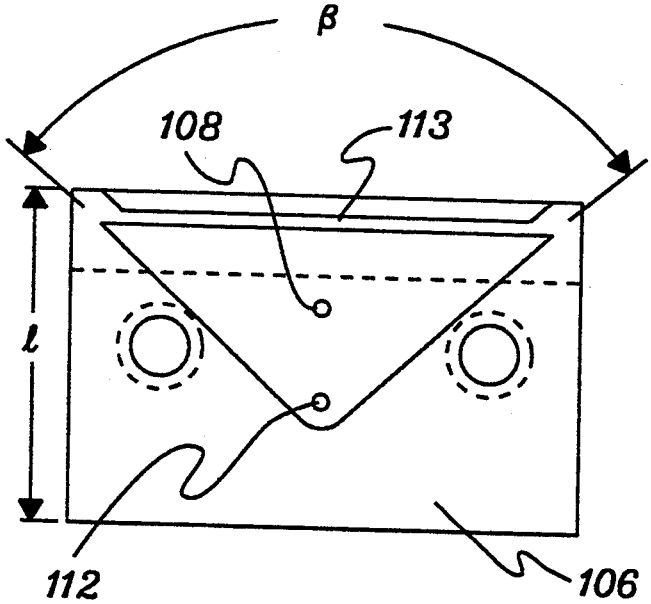
FIG. 13*a* is a cross-sectional plan view of FIG. 11*a* taken along lines VI—VI.
Figure 13B:
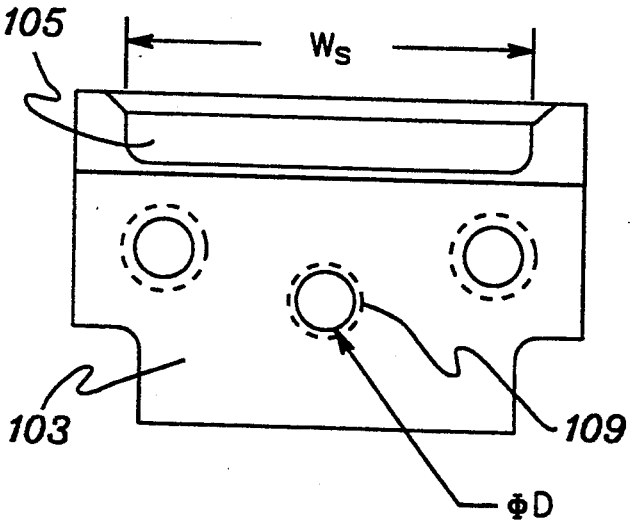
FIG. 13*b* is a cross-sectional view of FIG. 12 taken along lines VII—VII.

Third, the liquid applicator provides one of the needed surfaces to form the meniscus (FIG. 12). The meniscus forms by the interaction of the ultrasonic surface wave on the feed blade and the flow of liquid from the output surface of the liquid applicator. The size of the meniscus is dependent upon the liquid flow rate, i.e., the higher the flow rate the larger the meniscus. The internal dimensions and position of the liquid applicator are selected for each application so that the meniscus forms properly and over the flow range for each liquid type.

2) Surface (Δ1 w)—Feed Blade

Figure 14:
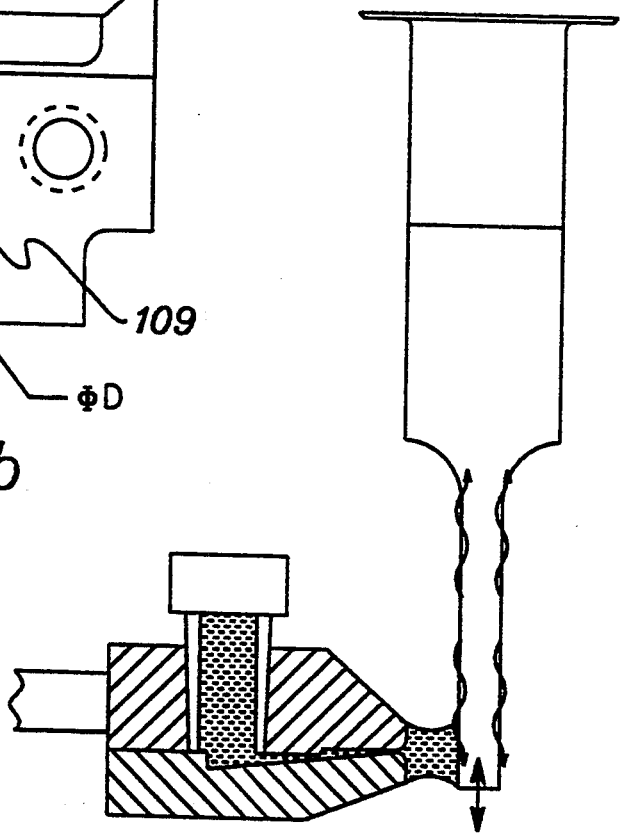
FIG. 14 is a partial cross-sectional elevational view of the liquid applicator and spray forming tip operated in accordance with the present invention.

The spray forming tip supplies a uniform ultrasonic surface wave that moves in the (positive) +z-axis direction on the surface of the feed blade (Δ1 w). The ultrasonic surface wave on the feed blade causes the liquid supplied from the output orifice of the liquid applicator to adhere or 'wet' to the feed blade, thereby forming a meniscus between the output orifice of the liquid applicator and the feed blade as illustrated in FIG. 14. The uniformity of the meniscus across the width (w) of the feed blade is directly proportional to the uniformity of the ultrasonic surface wave on the feed blade (Δ1 w). A uniform ultrasonic surface wave enables the meniscus to form uniformly, thereby providing a uniform flow of a liquid from the feed blade to the atomizing surface of the spray forming tip.

3) Surface (d w)—Atomizing Surface

By design, the spray forming head supports a longitudinal displacement wave in which maximum displacement in the +z-axis directions occurs uniformly over surface (d w). The ultrasonic displacement wave draws or 'pumps' the liquid from the feed blade to the atomizing surface (d w), distributes the liquid into a uniform film over surface (d w) and then transforms the film into droplets that are propelled from surface (d w) in the (positive) +z-axis direction. The flow rate range (or atomization rate) for a particular liquid is directly proportional to the amplitude of the displacement wave on surface (d w). The quality of the resulting spray pattern is directly related to the uniformity of the displacement wave on surface (d w).

4) Interaction between the Spray Forming Tip and Liquid Applicator (The liquid applicator and the spray forming tip do not come into physical contact.) The interaction between the spray forming tip and the liquid applicator takes place through the formation of a meniscus of liquid between the two elements. Once liquid flow is established through the liquid applicator, either by gravity feed or a low pressure source (<30 psi), and the liquid applicator is properly positioned with respect to the feed blade of the spray forming tip, the liquid adheres to the feed blade by the action of the ultrasonic surface wave on the feed blade. A meniscus of liquid forms along the width (w) of the feed blade from which liquid is pumped to the atomizing surface (d w) by the action of the longitudinal displacement wave. A film of liquid then forms over the atomizing surface and is atomized and propelled away in the form of a spray. The meniscus forms when the liquid supplied from the liquid applicator comes into contact with the ultrasonic surface wave that exists on the feed blade (Δ1 w). The meniscus of liquid adheres to the feed blade surface (Δ1 w) and is uniformly distributed along the width of the spray forming tip due to the uniform distribution of surface waves on the feed blade surface (Δ1 w). The liquid is drawn from the feed blade to the atomizing surface by the pumping action of the longitudinal ultrasonic displacement wave on surface (d w). The liquid is then distributed as a film on the atomizing surface and transformed into a spray and propelled from surface (d w). The formation of this meniscus is critical to achieving the desired uniform spray pattern and is independent of the orientation of the spray forming head when rotated about the y-axis, i.e., the same results are achieved when the spray forming head is spraying from below a surface to be coated or from above a surface to be coated.

The flow rate range is determined by the amplitude of the displacement waves on surface (d w) of the spray forming tip. The minimum flow rate that can be sustained uniformly, is the rate at which the liquid is drawn from the feed blade by the longitudinal displacement wave on surface (d w). The maximum flow rate that can be sustained uniformly, is the rate slightly below the point that the film thickness of liquid on the atomizing surface (d w) increases to the point where the ultrasonic energy of the displacement wave is insufficient to atomize the liquid. The liquid flow rate is infinitely adjustable between the minimum and maximum points.

Figure 2:
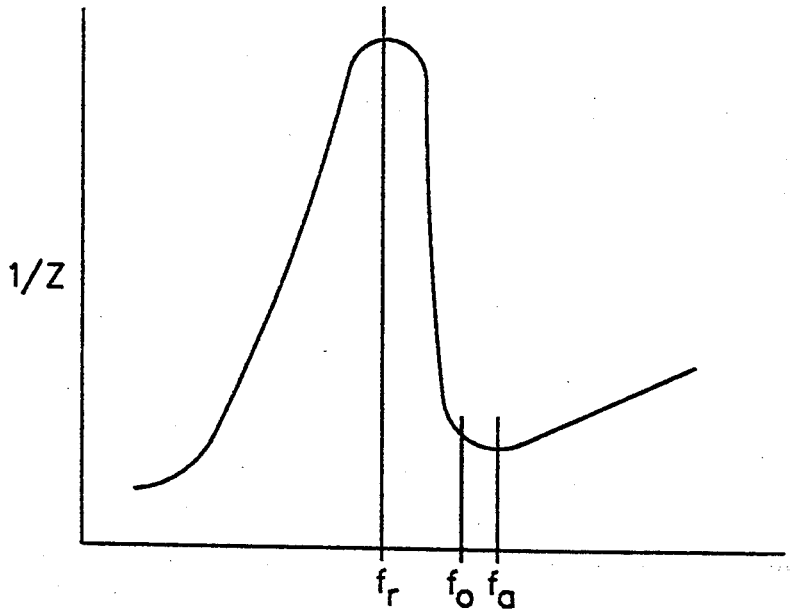
FIG. 2 is a plot of admittance (1/Z) of the converter mechanism/spray forming head as a function of drive frequency.

A voltage generator preferably drives in parallel multiple spray assemblies of the same operating frequency. The circuitry is designed to include the spray forming head assemblies in the frequency control path for automatic frequency control and to adjust power according to system demand. The operating frequency ($f_0$) generated is between the resonant frequency ($f_r$) and the anti-resonant frequency ($f_a$) of the spray head(s), as shown in FIG. 2, such that a proper ultrasonic wave system is established in the spray forming tip. The ultrasonic generator is designed to generate and maintain the required operating frequency during changing environments such as ambient temperature. Additionally, the amplitude of the ultrasonic output from the generator is adjustable to accommodate the flow rate requirements of various situations.

The power generator features a unique full bridge power output circuit configuration together with a frequency driven pulse mode driver. The converter comprises a half wave cylindrical composite structure utilizing ring-shaped piezoelectric ceramics and metal sections in a typical Langevin-type sandwich structure. A cylindrical flange is formed at the ceramic end of one of the metal sections about which is fitted one end of a protective cover for the ceramic section. The flange is located at the nodal plane of the resonant structure thereby eliminating loss of ultrasonic energy to the cover element. Electrical conductors are brought through a port in the other end of the cover. The cover ends are sealed liquid and gas tight. The exposed end of the structure is drilled and threaded to enable mechanical connection to a solid spray head section. The converter structure is designed to be operated at a specific desired frequency. All exposed surfaces are made from materials selected for minimum corrosion when exposed to spray materials.

A spray forming head, or a plurality of spray forming heads, are half wave resonant at the same frequency of the matching converter drivers. Spray forming heads are designed considering first the type and rate of flow of liquid to be sprayed in order to determine the frequency and energy requirements and second the width of the spray pattern to determine the area and length of the atomizing tip of the spray forming head. Thereby, spray forming heads may be custom matched to the application and driven by standard converters and can be easily replaced if erosion occurs due to use. The liquid applicator is provided with a slotted passage with a slot length equal to slightly less than the width of the spray forming head and a slot width sufficient to permit the desired amount of liquid to be applied to the feed blade of the spray forming tip. The shape and dimensions of the liquid passage in the applicator are critical to the uniform control of the flow of liquid to the entire area of the feed blade to the atomizing surface. Gas entrainment of the spray is provided with a Primary Gas Director and an Auxiliary Gas Director. The Primary Gas Director impinges a stream of gas onto the feed blade side of the spray forming tip opposite the liquid applicator. The Auxiliary Gas Director impinges a gas stream onto the bottom side of the Liquid Applicator. These 'opposing' gas streams are used to expand the width of the spray pattern to as much as eight (8) times the width of the atomizing surface of the spray forming head.

The components of an ultrasonic spray coating system pursuant to the present invention, one embodiment of which is shown in FIG. 3, include a converter or transducer 11 which produces vibrations by converting high frequency electrical energy into high frequency mechanical energy. A spray forming head 12, preferably rectangular, is resonant at the converter resonant frequency and concentrates the mechanical vibrations at its spray forming tip 13*a*. A fluid applicator 14 distributes fluid to the feed blade of the spray forming tip 13*b*. A high frequency alternating voltage generator 15 produces a controlled level of electrical energy at the operating frequency of the spray forming head-converter system.

Converter 11 is a resonant structure which delivers a maximum vibration amplitude to the output end of its front section 16. The converter 11 may comprise a derivative of the Langevin sandwich type which uses lead zirconate titanate, or PZT, for the piezoelectric material and 6AL-4V titanium for the front section metal and 300 series stainless steel for the end section metal. The PZT elements (not shown) are preferably sandwiched between the metal elements by a high strength central bolt and tightened to provide a bias compressive pressure sufficient to prevent fatigue failure of the PZT material.

The PZT elements are protected from contamination and damage by a cover attached at the nodal plane on the front section to avoid energy losses. The converter 11 is designed and fabricated to operate within ±0.05% of the design frequency. Electrical energy is applied to the PZT elements from the alternating voltage generator 15 adjusted to operate at the operating frequency of the structure.

A mounting bracket 17 affixes the converter 11, the spray head 12 and the fluid supply applicator 14 to a mounting frame or platform 18, as shown in FIG. 3.

The spray forming head 12 is preferably rectangular and is designed to be resonant at the frequency of the driving converter 11. This type of resonant structure is described in *Ultrasonic Engineering,* by J. R. Frederick, John Wiley and Sons, Inc. 1965. The converter 11 is affixed to the spray forming head 12 by a tension bolt (not shown) which permits assembly and disassembly, as required for maintenance or other operations. The ultrasonic path from the converter 11 to the spray forming tip 13 is designed to provide: a uniform distribution of ultrasonic surface waves on the feed blade surface (Δ1 w) 13*b* across the spray forming head width (w); compression waves moving in the ±z-axis direction perpendicular to surface (d w) 13*a;* a uniform distribution of compression waves on surface (d w); and a maximum displacement of the compression waves with minimum electrical energy to said converter.

The spray forming head is designed with the step precisely at Δ/4 of the resonant frequency and a length of Δ/2+Δ length. (The step is provided to amplify the ultrasonic vibrations produced by the converter. Amplification ratios between ×2 and ×2.5 can be achieved.) The length of the spray forming head is then cut back as part of the tuning process. The spray forming heads are "tuned" to a reference resonant frequency such that multiple spray forming heads may be operated simultaneously from the same ultrasonic power source and to optimize the distribution of ultrasonic waves in the spray forming tip(s).

Liquid is introduced to the feed blade 13 of the spray forming head 12 through the formation of a meniscus of liquid between the feed blade and the liquid applicator. The meniscus is caused to form by the ultrasonic surface waves of the spray forming tip in contact with the liquid supplied by the liquid applicator. The meniscus of liquid is fed from the slotted orifice 19 (FIGS. 3 & 5) formed in the output surface 20 of the liquid applicator 14. Orifice 19 has a slot length slightly less than the width (w) of said spray forming head in a manner whereby liquid supplied by said applicator is applied to said meniscus. The surface waves of said feed blade draw the liquid from the meniscus to surface (d w) where the liquid is atomized by the ultrasonic displacement waves and is thereby changed to a spray. The liquid flow rate and ultrasonic wave system amplitude must be controlled to maintain the desired liquid atomization.

Figure 6:
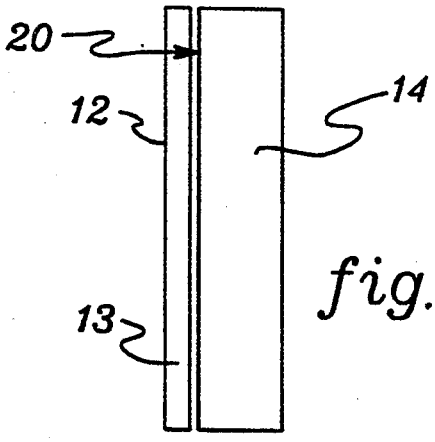
FIG. 6 is a view, on an enlarged scale, taken along lines IV—IV of FIG. 3.

The output surface 20 of the applicator 14 is in close proximity with the spray forming tip 13 and spaced therefrom, and said output surface and spray forming tip are at substantially right angles to each other, as shown in FIGS. 3 & 6. The tip 13 and the output surface 20 have substantially parallel lengths, as shown in FIG. 6, and the orifice 19 (FIGS. 3 & 5) is a continuous slot with a width "s" as shown in FIG. 5, in a range of substantially 0.025 mm to 0.38 mm. The width "s" is sufficient to permit the desired flow of liquid to be applied to the feed blade of the spray forming tip 13. The shape and dimensions of the liquid passage in the applicator are important to the uniform distribution of liquid to the meniscus.

The liquid applicator 14 may be customized during final assembly for each application. The applicator 14 distributes the liquid to the meniscus via orifice 19. The applicator 14 is coupled to an external liquid supply or reservoir 12 via swage type tube fittings 23 (FIG. 3). The liquid supply 22 and the orifice 19 are designed in accordance with hydrostatic principles to provide a steady liquid flow to the meniscus of liquid. The width 's' of the orifice 19 is proportioned in accordance with the type of liquid being applied.

Figure 7:
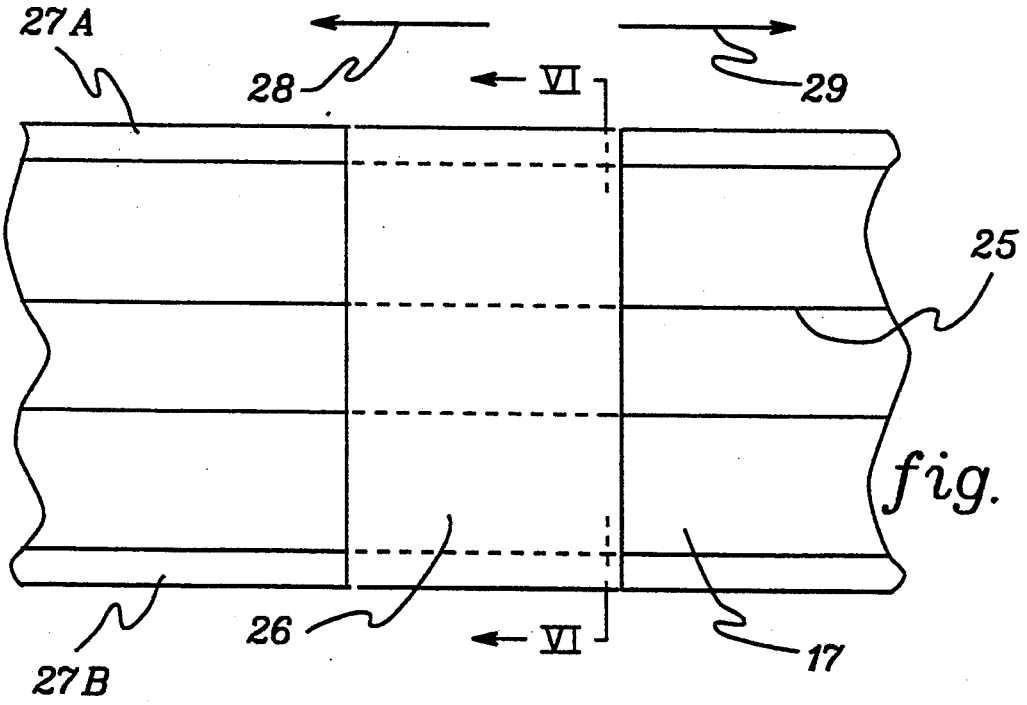
FIG. 7 is a top plan view of the ultrasonic spray coating system of FIG. 3.

The liquid supply applicator 14 is affixed to an applicator bracket 24, which is affixed to the mounting bracket 17 (FIG. 3). The mounting bracket 17 has a linearly extending slot 25 formed therethrough, as shown in FIG. 7. The applicator bracket 24 is supported by a carriage 26 of any suitable type via a portion of said applicator bracket extending through the slot 25 whereby said applicator bracket is suspended from said carriage on the mounting bracket. The carriage 26 is movable along a linear track 27A, 27B, in directions of arrows 28 and 29, by any suitable means, such as, for example, electrical energization of an electric motor 30 mounted on the carriage 26 via an electrified third track (not shown), or one of the tracks 27A and 27B (FIG. 7).

Motor 30 of any suitable known type (for example, an electric motor), is mounted on the carriage 26 and coupled to the applicator bracket 24 by any suitable means, such as, for example, a rack and pinion, or gear arrangement 31 (FIG. 8) of any suitable known type. The motor 30 is thus readily electrically controlled to move the applicator bracket 24 in the direction of arrows 32 and 33 at any position of the carriage 26, whereas said carriage is readily electrically controlled to position itself, and thus said applicator bracket, at any desired position on the mounting bracket 17.

Figure 8:
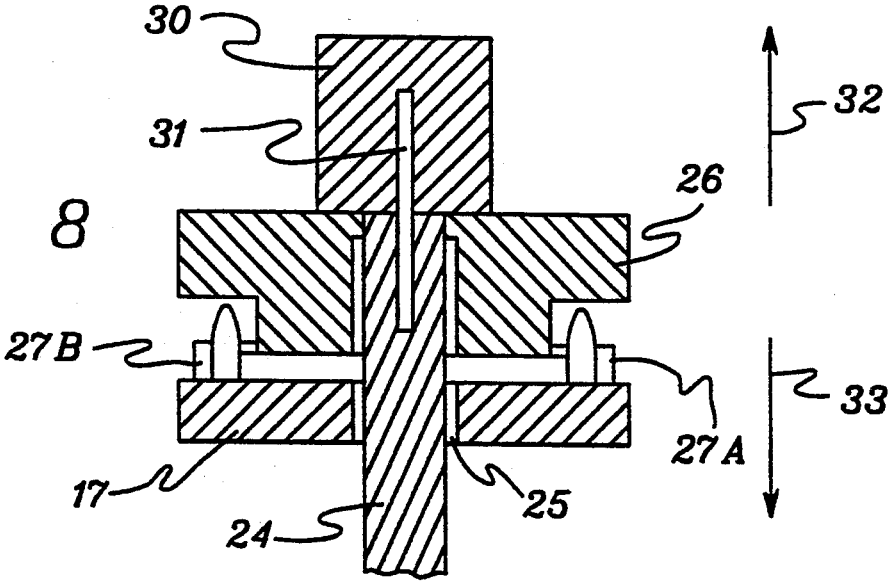
FIG. 8 is a cross-sectional view taken along lines VI—VI of FIG. 7.

Thus, as shown in FIGS. 7 & 8, the applicator is adjustably positionable relative to the spray forming tip 13 of the spray forming head 12 in planes substantially parallel to and in planes substantially perpendicular to the spray forming tip.

The high frequency alternating voltage generator 15 utilizes MOSFET power transistors in a bridge type, transformer-coupled configuration (not shown) to provide power to the converter 11. The DC supply voltage to the bridge circuit is varied to control the level of voltage delivered to one or more parallel-connected converters (not shown), as desired. The control and drive circuit for the bridge transistors utilizes a voltage-controlled oscillator configuration (not shown) to generate the frequency required for the array of converters.

The spray coating system of the invention uses macrosonic, or high-intensity ultrasonic, vibrations to atomize fluid. The vibrations produce capillary waves on a film of fluid which is drawn from the meniscus to the macrosonically vibrating spray forming tip 13. A sufficiently large vibration amplitude causes small diameter drops to break from the crests of the capillary waves and to be thrown from the spray forming tip 13. The mean drop diameter "d" is related to the operating frequency and has been characterized, in "Ultrasonics"

by D. Ensminger, Marcel Dekker, 1988, for a very low flow and drive amplitude as follows:

$$d \approx k\lambda c \text{ cm}$$

where "λc" is the wavelength of the capillary waves and is approximated by:

$$\lambda c \approx \left(\frac{8\pi T}{\sigma f^2}\right)^{\frac{1}{3}}$$

where "T" is the surface tension, "a" is the density of the fluid, "f" is the drive frequency in Hz and "k" is an experimentally determined constant which is less than, or equal to 0.5.

For a system atomizing water at 25° C. and operating at 50 kHz this calculation provides a mean drop size of under 50 μm and compares well with experience.

Figure 10:
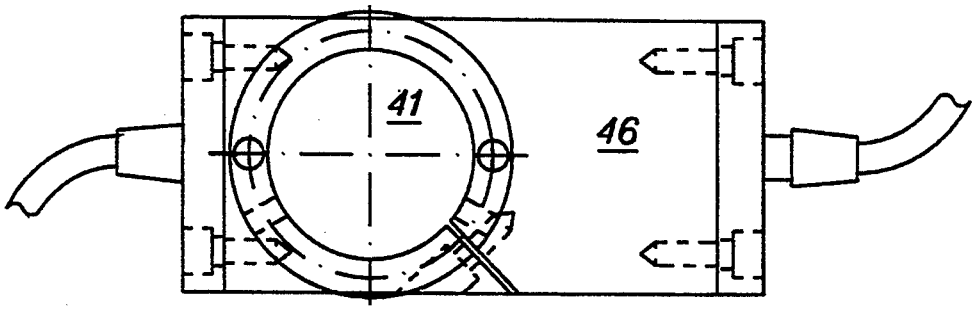
FIG. 10 is a top plan view of the ultrasonic spray coating system of FIG. 9.
Figure 9:
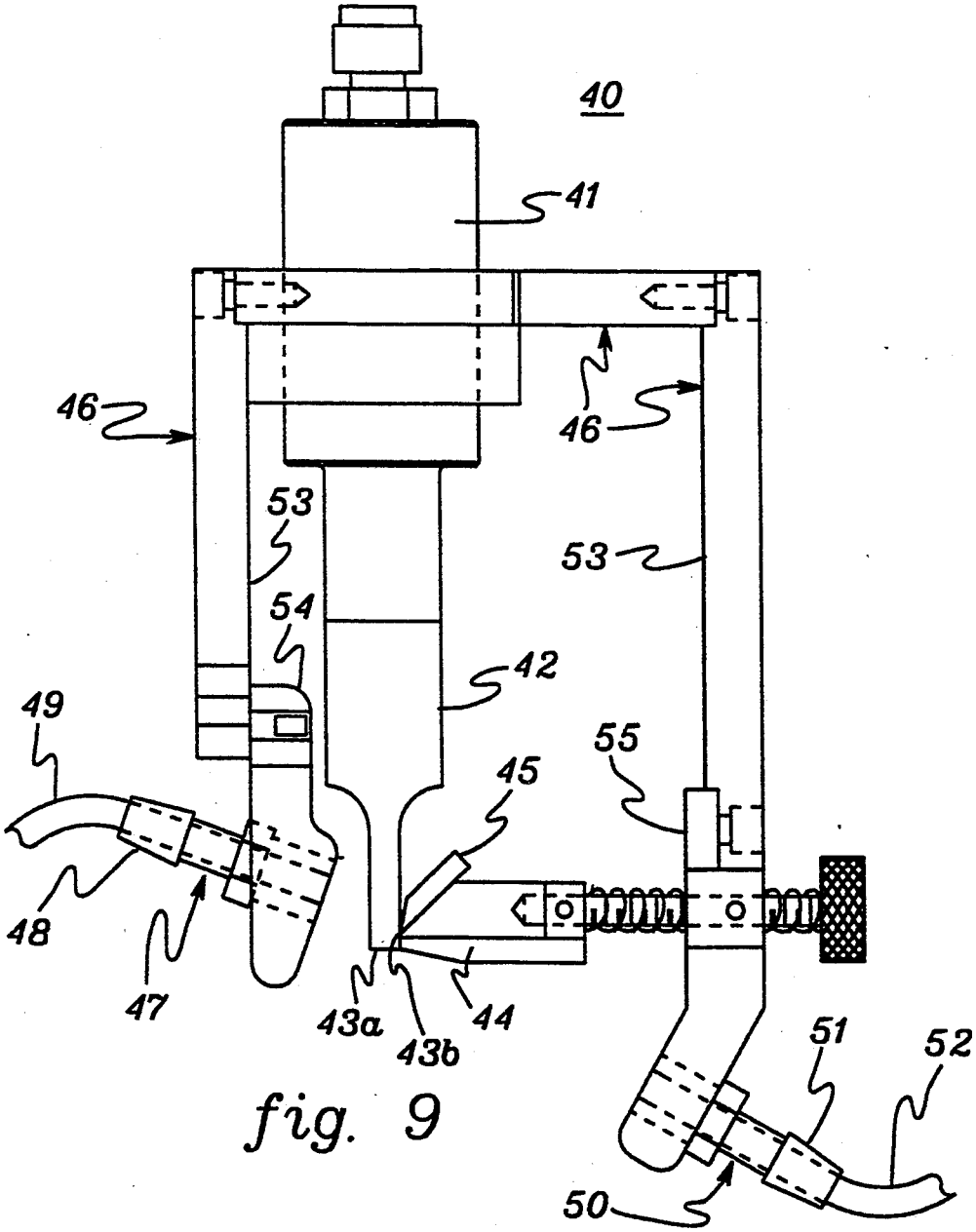
FIG. 9 is an elevational view of an enhanced embodiment of the ultrasonic spray coating system of the present invention.
Figure 11B:
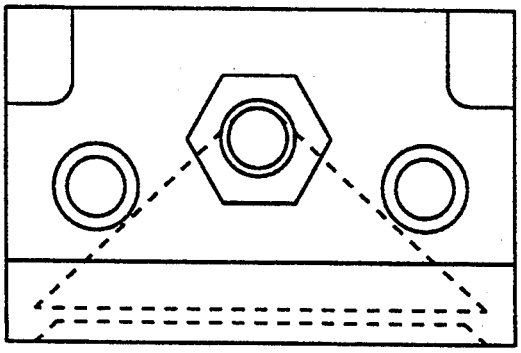
FIG. 11*b* is a top plan view of the liquid applicator of FIG. 11*a;*
Figure 11A:
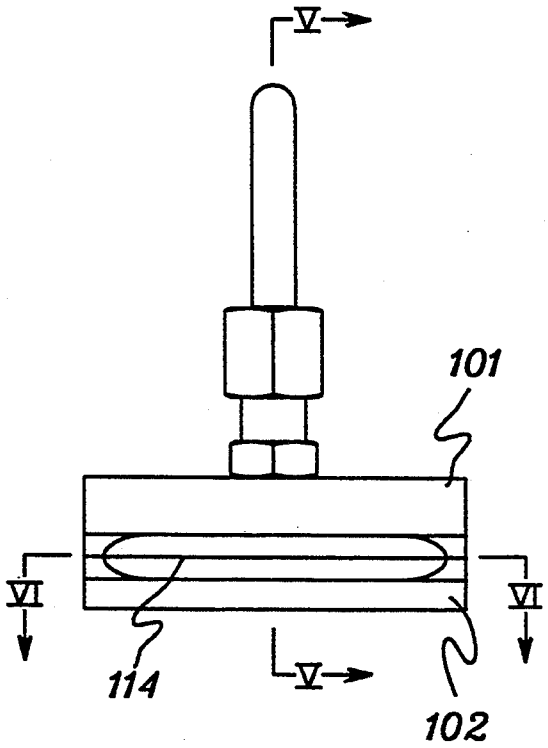
FIG. 11*a* is an elevational front view of a liquid applicator in accordance with the present invention.

An enhanced embodiment of the present invention, generally denoted at 40, is depicted in FIGS. 9 & 10. As with the prior embodiment, system 40 includes a converter 41 to produce high frequency vibrations, and a spray forming head 42, which is preferably rectangular and resonant at the converter resonant frequency. Spray forming head 42 develops an ultrasonic wave system in the spray forming tip. Associated with surface 43 is a liquid applicator 44 similar to applicator 14 discussed-above in connection with FIGS. 3–8. A liquid dam 45 is associated with the liquid applicator.

The purpose of liquid applicator 44 is to deliver a controlled amount of liquid to the meniscus of liquid that is formed between the liquid applicator and the spray forming tip. The meniscus is formed by the interaction between the liquid and the ultrasonic wave system established in the spray forming head. The ultrasonic spray forming tip draws the liquid from the meniscus to the atomizing surface 43 of the spray forming tip and converts it into a spray. The delivery of liquid to the meniscus must be uniform so that the liquid is fed at the same rate to all points in the meniscus as it is being drawn from the meniscus by the ultrasonic wave system in the spray forming tip. Further, dimensions of the internal passageways of the liquid applicator are selected to maintain a laminar flow into the meniscus throughout the required flow rate range of a particular situation.

As noted above, meniscus is formed by the interaction of the ultrasonic wave system established in the spray forming head, the liquid properties (i.e., surface tension, viscosity, contact angle, etc.), flow rate, liquid applicator design and liquid applicator position. If one of these parameters (such as formation of the proper ultrasonic wave system, liquid applicator design or applicator position) is not applied correctly, meniscus will not form, and therefore the system will not provide a uniform coating. For example, a meniscus will not form in absence of the ultrasonic vibrations containing the proper ultrasonic wave system at the proper amplitude for the liquid type and flow rate range. Further, meniscus will not form if the applicator is not positioned correctly (in three axes: horizontal, vertical and rotational). Also, meniscus will not form if the internal passage and output slot of the applicator is not formed correctly for the liquid type and flow rate.

The liquid dam 45 is designed to ensure that the meniscus remains intact when spraying from below the surface to be coated. The liquid dam consists of a plastic plate fastened to the angled surface on the top half of the liquid applicator which comes into contact with surface (Δ1 w) of the spray forming tip to 'fill in' the space below the meniscus. The position of the liquid dam is adjustable to allow for various distances between the liquid applicator and spray forming tip. The liquid dam ensures that the surface tension of the liquid in the meniscus is not disrupted by external shocks or vibrations when the spray forming head is spraying from below the object to be coated and thus ensures that a uniform distribution of coating can be achieved in practical situations.

The liquid applicator is empirically designed to accommodate properties of various liquids such as viscosity and surface tension in conjunction with operating parameters such as flow rate, to achieve a desired uniform delivery of liquid to the meniscus. Internal dimensions are such that for a given set of operating parameters: (1) the liquid flow is laminar as it passes through the applicator; and (2) the material properties of the liquid as they interact with the internal surfaces do not interfere with the flow pattern (i.e., surface tension of liquid does not disturb the flow pattern).

A depth angel '$\alpha$' of 5° and a width angle '$\beta$' of 90° are believed optimal for the flow distributor. In general, as the width 'w' of the liquid applicator is increased, the length '1' of the liquid applicator must be increased proportionally to maintain a width angle of 90°. For widths greater than 50 mm, two or more flow distributors should be machined into the bottom plate with two or more liquid ports in the top plate centered over the apex of the flow distributors.

The ratio 'w/s' (i.e., the width of the output orifice 'w' divided by the width of the slot opening 's',) defines useable output orifice size of the liquid applicator. In practice "w/s" ranges from 100 to 2000 for an output orifice width between 38 mm to 50 mm. The Reynolds Number "$Re_w$" for the liquid flow through the applicator based of the output orifice width has been found to be approximately 39,000.

Pursuant to this enhanced embodiment of the invention, a bracket assembly 46 is coupled to converter 41 for adjustably positioning a primary gas director 47 and an auxiliary gas director 50 relative to spray forming head 42 and liquid applicator 44, respectively. Together, primary gas director 47 and auxiliary gas director 50 define an gas entrainment mechanism which is employed to control (enhance) the pattern and velocity of spray projecting from spray forming tip atomizing surface 43. Further, this gas entrainment mechanism is employed to expand the area of the work surface undergoing a coating operation.

Primary gas director 47 includes a coupling 48 and an air hose 49 connected thereto for delivery of a stream of gas onto a flat side surface of spray forming head 42 as shown in FIG. 9. (Note that any desired gas, such as nitrogen, may be substituted for air in the entrainment mechanism.) This impinging of the gas stream onto the side of spray forming head 42 produces a fan-shaped air pattern which operates on the spray emitted from spray forming tip 43. If desired, this fan-shaped pattern could be used individually to expand the spray surface and/or increase the velocity to enhance coating application in various situations. As the liquid is atomized from the spray forming tip of the spray forming head, the atomized drops are entrained in the resulting gas pattern and transferred to the object to be coated.

Figure 15:
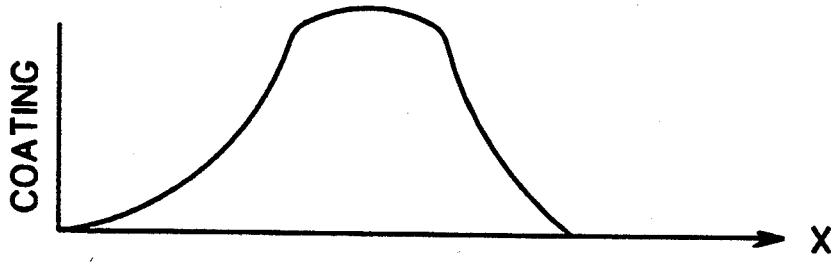
FIG. 15 is a plot of a coating distribution utilizing a primary air director only in accordance with the present invention.

By employing only the primary gas director, the resultant coating distribution on the work surface will tend to be "bell-shaped" shown in FIG. 15. Depending upon the application, such a distribution may be acceptable. If, however, a more uniform coating of the work surface is required, then an auxiliary gas director 50 is employed.

Figure 16:
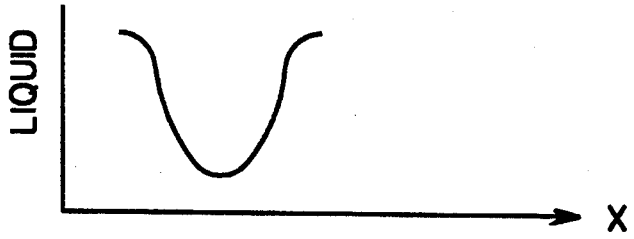
FIG. 16 is a plot of liquid distribution on atomizer surface.
Figure 17:
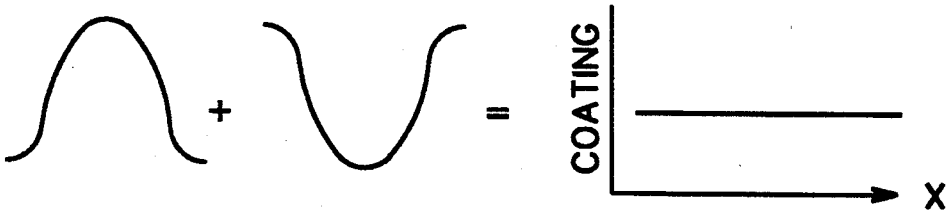
FIG. 17 depicts graphically the combining in accordance with the present invention of a coating distribution resulting from the primary air director and the coating distribution on the atomizer surface.

Gas director 50 includes a coupling mechanism 51 and an air hose 52. In most applications, air from primary air director 47 will be at a substantially greater flow rate than air from auxiliary air director 50 (for example, 10×). Auxiliary air director 50 is positioned such that a stream of air extending therefrom impinges on the lower surface of liquid applicator 44, thereby interacting with the liquid on the spray forming tip of the spray forming head. This auxiliary air/liquid interaction redistributes liquid on the spray forming tip in its own "bell-shaped" pattern as shown in FIG. 16. The bell-shaped pattern attributable to auxiliary air director 50 is inverted relative to the bell-shaped pattern formed from primary air director 47 such that when the two directors are positioned substantially in opposing relation as shown in FIG. 9, then a uniform coating distribution is attained at the work surface as shown in FIG. 17.

The flow of gas through the gas directors can be characterized by the dimensionless Reynolds Number:

$$Re_d = VD/v$$

where:

V = velocity of the gas flow in meters/second;

d = internal diameter of the fitting attached to the gas director in meters; and v = kinematic viscosity of the gas in meter$^2$/second. It has been determined empirically that the optimum flows for the primary gas director range from $Re_d \approx 15700$ to $Re_d \approx 26200$ and for the auxiliary air director $Re_d \approx 1970$ to $Re_d \approx 3940$. These flows are proportional to the liquid flow rate and provide a uniform coating distribution.

In the embodiment depicted, bracket assembly 46 includes multiple segments (53, 54, 55) which are mechanically affixed together as shown in phantom. Use of multiple detachable segments (53, 54, 55) provides a set up operator with greater freedom in positioning the air directors. Obviously, however, a unitary support structure could be employed if desired.

In all embodiments, the present invention comprises an ultrasonic spray coating system with spray velocity control which is inexpensive to manufacture and operate, and is simple to maintain and utilize. The system produces a coating of liquid of desired uniformity, precision, shape and thickness on a work surface. There is minimal waste of coating liquid with over 90% of the atomized liquid being delivered to the work surface to be coated. Special air directors expand the spray width (uniformly) to widths greater than that of the spray head atomizing surface. Further, control of spray velocity is enhanced to facilitate coating application in various situations.

Although specific embodiments of the present invention have been illustrated in the accompanying drawings and described in the foregoing detailed description, it will be understood that the invention is not limited to the particular embodiments described herein, but is capable of numerous rearrangements, modifications and substitutions without departing from the scope of the invention. The following claims are intended to encompass all such modifications.

We claim:

1. A method for propelling a spray from a spray forming tip, said method comprising:

(a) positioning a liquid supply applicator in close proximity with said spray forming tip and spaced therefrom such that an output surface of said liquid supply applicator and said spray forming tip are at substantially right angles to each other;

(b) providing ultrasonic waves to said spray forming tip such that a liquid supplied by said applicator is caused to flow to and on said spray forming tip by said ultrasonic waves and said liquid is atomized by said ultrasonic waves and is thereby changed to a spray;

(c) controlling said spray with a first directed stream of gas; and (d) controlling said spray with a second directed stream of gas, said first and second directed streams of gas cooperating to substantially uniformly expand and entrain said spray.

2. The method of claim 1, wherein said controlling steps further comprise positioning said first directed stream of gas and said second directed stream of gas in opposing relation.

3. The method of claim 2, wherein a direction of either said first directed stream of gas or said second directed stream of gas is substantially parallel to said spray forming tip.

4. The method of claim 1, wherein said first directed stream of gas and said second directed stream of gas each have a flow rate, and further comprising controlling each said flow rate.

5. The method of claim 1, wherein said first directed stream of gas and said second directed stream of gas impinge symmetrically at said spray forming tip to uniformly expand and entrain said spray.

6. The method of claim 1, wherein at least one of said first directed stream of gas and said second directed stream of gas comprises one of air and nitrogen.

7. The method of claim 1, further comprising modifying the location and orientation of at least one of said first directed stream of gas and said second directed stream of gas.

8. A method for controlling a spray being propelled from an atomizing surface, said method comprising:

(a) providing a first gas director proximate to said atomizing surface, said first gas director projecting a first stream of gas in a first gas direction;

(b) positioning said first gas director such that said first stream of gas laterally redistributes said spray on or near said atomizing surface to thereby control a velocity and a pattern of said spray being propelled;

(c) providing a second gas director proximate to said atomizing surface, said second gas director projecting a second stream of gas in a second gas direction; and (d) positioning said second gas director such that said second gas direction is in substantially opposing relation to said first gas direction, wherein said second stream of gas cooperates with said first stream of gas to substantially uniformly expand and entrain said spray.

9. The method of claim 8, wherein said first stream of gas and said second stream of gas each comprise a flow rate, and further comprising controlling each said flow rate.

10. The method of claim 8, further comprising adjusting location and orientation of said first gas director and said second gas director such that said pattern and said velocity of said spray are modified.

11. The method of claim 8, wherein said first stream of gas and said second stream of gas impinge symmetrically at said atomizing surface to uniformly expand and entrain said spray.

12. The method of claim 8, wherein either said first stream of gas or said second stream of gas comprises one of air and nitrogen.

13. An ultrasonic system for propelling a spray, said system comprising:

converter means for producing high frequency mechanical energy from high frequency electrical energy;

a spray forming head driven by said high frequency mechanical energy produced by said converter means, said spray forming head having an atomizing surface for propelling said spray;

a first gas director mounted near said spray forming head, said first gas director for projecting a first stream of gas in a first gas direction, said first stream of gas laterally redistributing said spray propelled from said atomizing surface; and a second gas director for projecting a second stream of gas in a second gas direction, said second gas direction being in opposing relation to said first gas direction such that said second stream of gas cooperates with said first stream of gas to substantially uniformly expand and entrain said spray.

14. The system of claim 13, wherein said first stream of gas and said second stream of gas projected by said first gas director and said second gas director, respectively, each has an independent flow rate.

15. The system of claim 13, wherein location and orientation of said first gas director and said second gas director are adjustable relative to said spray forming head.

16. The system of claim 13, wherein said first gas director and said second gas director cooperate to modify the velocity of said spray propelled from said atomizing surface.

17. The system of claim 13, wherein said first gas director and said second gas director cooperate to control said spray propelled from said atomizing surface so as to modify a contact area of said spray on an associated work surface.

18. The system of claim 13, wherein said first stream of gas and said second stream of gas impinge symmetrically on said spray propelled from said atomizing surface to uniformly expand and entrain said spray.

19. The system of claim 13, wherein at least one of said first stream of gas and said second stream of gas comprises one of air and nitrogen.

* * * * *

UNITED STATES PATENT AND TRADEMARK OFFICE

CERTIFICATE OF CORRECTION

PATENT NO. : 5,409,163

DATED : Apr. 25, 1995

INVENTOR(S) : Erickson et al.

It is certified that error appears in the above-indentified patent and that said Letters Patent is hereby corrected as shown below:

Title page, insert item: [63], "Continuation-in-part of" (first occurrence) and substitute therefor --Related to--.

Column 1, line 7, delete "a continuation-in-part of" and substitute therefor --related to--.

Column 1, line 20, delete "." second occurrence.

Column 6, line 57 delete "+z-axis directions" and substitute therefor --±z-axis direction,--.

Column 9, line 34, delete "Δ/4" and susbstitute therefor --λ/4--.

Column 9, line 35, delete "Δ/2 + Δ length" and substitute therefor --λ/2 + Δ length--.

Column 11, line 12, delete ""a"" and substitute therefor --σ--.

Signed and Sealed this

Fifth Day of September, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,409,163

DATED : Apr. 25, 1995

INVENTOR(S) : Erickson et al.

It is certified that error appears in the above-indentified patent and that said Letters Patent is hereby corrected as shown below:

Title page, under item [63], delete "Continuation-in-part of" (first occurrence) and substitute therefor --Related to--.

Column 1, line 7, delete "a continuation-in-part of" and substitute therefor --related to--.

Column 1, line 20, delete "." second occurrence.

Column 6, line 57 delete "+z-axis directions" and substitute therefor --±z-axis direction,--.

Column 9, line 34, delete "Δ/4" and susbstitute therefor --λ/4--.

Column 9, line 35, delete "Δ/2 + Δ length" and substitute therefor --λ/2 + Δ length--.

Column 11, line 12, delete ""a"" and substitute therefor --σ--.

This certificate supersedes Certificate of Correction issued September 5, 1995.

Signed and Sealed this

Fourteenth Day of November, 1995

Attest:

Bruce Lehman

BRUCE LEHMAN

Attesting Officer

Commissioner of Patents and Trademarks